United States Patent [19]

Pampuch

[11] 4,174,710

[45] Nov. 20, 1979

[54] CONNECTION BETWEEN TWO DIFFERENT PARTS OF A PERSON'S PROTECTIVE COVERING

[75] Inventor: Klaus Pampuch, Berlin, Fed. Rep. of Germany

[73] Assignee: Auergesellschaft GmbH, Berlin, Fed. Rep. of Germany

[21] Appl. No.: 900,252

[22] Filed: Apr. 26, 1978

[30] Foreign Application Priority Data

Apr. 28, 1977 [DE] Fed. Rep. of Germany.....2718864

[51] Int. Cl.[2] ..... A62B 7/00

[52] U.S. Cl. ..... 128/142.7; 2/2.1 R

[58] Field of Search ..... 2/2.1 R, 173, 9; 277/208; 128/142.7, 142

[56] References Cited

U.S. PATENT DOCUMENTS

| | | | |
|---|---|---|---|
| 2,851,289 | 9/1958 | Pedersen | 277/208 |
| 3,175,560 | 3/1965 | Menzies | 2/2.1 R |
| 3,910,269 | 10/1975 | Ansite et al. | 128/142.7 |

*Primary Examiner*—Robert I. Smith

*Attorney, Agent, or Firm*—Brown, Flick & Peckham

[57] ABSTRACT

One of two parts of a protective covering for a person has an opening therein facing the other part, and one edge of an elastic band secured to the one part around that opening extends away from it and around a portion of the other part. The free edge of the band is thickened and provided with a continuous groove in its inner surface extending around the thickened portion and receiving one of a plurality of laterally spaced ribs encircling the surrounded portion of the other part of the protective covering to hold the two parts of the covering together.

7 Claims, 1 Drawing Figure

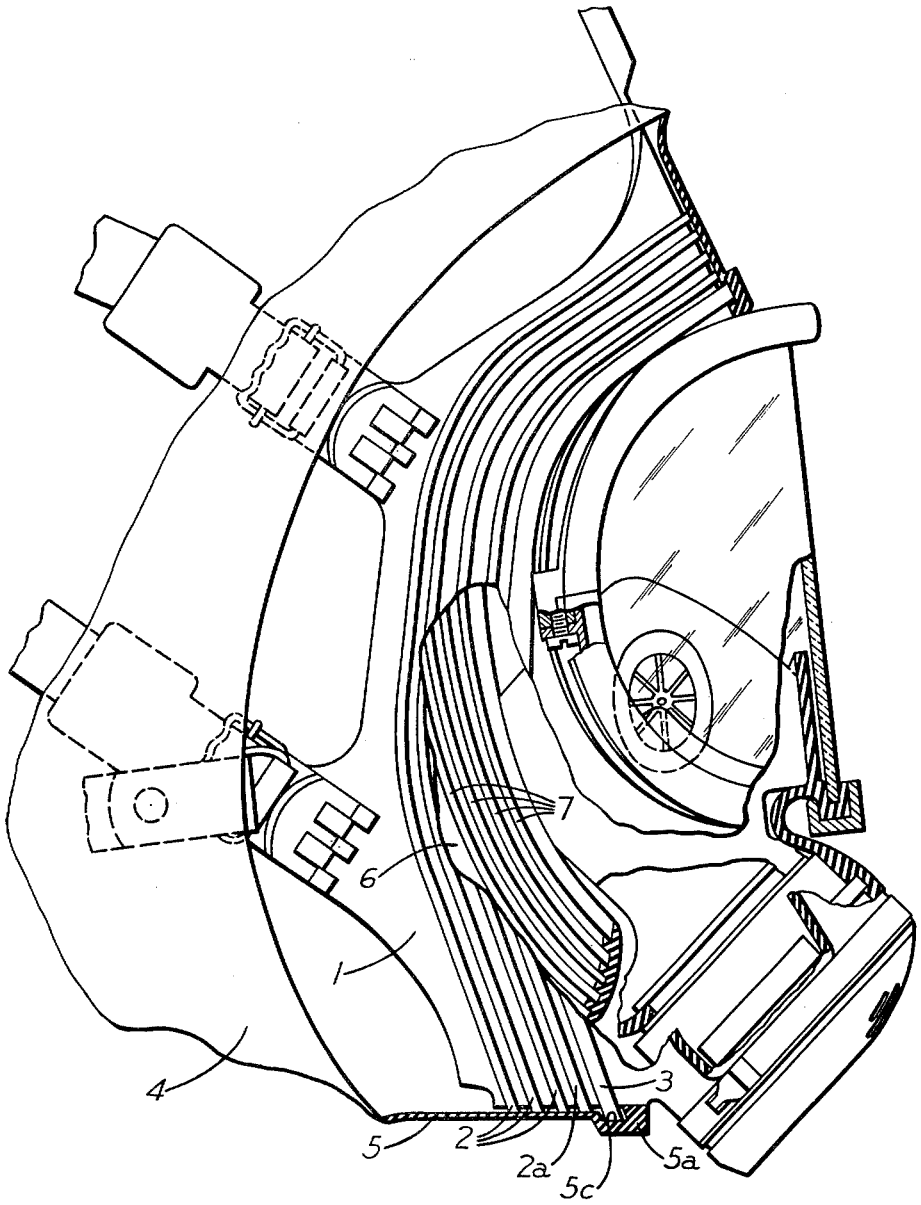
7
6
1
4
3
5
2
2a
5c
5a

CONNECTION BETWEEN TWO DIFFERENT PARTS OF A PERSON'S PROTECTIVE COVERING

The invention concerns a connection between two different parts of a protective covering, such as a respirator mask or protective suit, in which an elastic band is used as the binding agent between the two parts to be joined, the arrangement being such that the band borders an opening in one of the parts.

With a connection of this type, it is known that an elastic sealing strip in the form of a molded body and belonging to one of the two parts lies flat against the part with which the joint has to be made, in the course of which the sealing strip merely makes resilient contact with three especially developed places. It is obvious that this three-point contact made by the sealing strip is incapable of ensuring a substantially gas-tight joint between the two parts thus joined and, in addition, providing sufficient cohesive force for the union.

In another known type of connection, there is provided on one part of the protective clothing a lining whose free end forms an interspace with the end of the clothing part and in which the next piece of clothing engages. It is impossible with this known form of construction to form a gas-tight connection at the places of overlap, much less provide good adhesion at the junction point.

It is the principal object of this invention to form a connection or joint between two different parts of a protective covering, which holds them together securely and which is gas-tight.

The advantages to be gained by this invention reside, in particular, in the fact that by simple means a gas-tight joint is produced which, in addition, is secure against accidental release.

Based on the accompanying drawing, a more detailed description is given, by way of example, of a form of construction in accordance with the invention. The single FIGURE illustrates as an example a gas-tight connection between a protective suit and a respirator mask.

As may be seen from the drawing, a respirator mask 1 is provided with a number of ribs 2 and 2*a* that are spaced a suitable distance apart and that extend around the marginal portion of the mask and therefore around the entire face. The arrangement of the laterally spaced ribs is such that they form a sort of labyrinth. Spaced inwardly from, or in front of, rib 2*a* is an additional rib 3 that surrounds the mask parallel to the rib 2*a*. This additional rib serves as a retainer for a protective suit 4 that is to be connected to the mask, the rib 3 having an essentially square-shaped cross-section and projecting somewhat further from the mask than ribs 2 and 2*a*.

It is a feature of this invention that at the place where the protective suit 4 is to be joined to the mask, there is an elastic band 5 that serves as the connection or joint between them. This band surrounds an opening in the suit for the face of the wearer, and the rear or inner edge of the band is joined and sealed to the suit around that opening in any suitable manner. The band extends forward from the suit, and the front or free edge of the band has a thickened portion 5*a*, in which is formed a peripheral groove 5*c* extending around the interior of the band. The groove is of such size that it can receive the retainer rib 3.

In order to join suit 4 to the mask 1, the elastic connecting band 5, which forms part of the suit, is drawn forward over the ribs 2 of the mask and also over the rib 3. As a result, rib 3 is securely held in groove 5*c* to connect the suit and mask, and the smooth inside surface of the elastic band overlaps and engages ribs 2 of the mask with a certain contact pressure and thus produces, in association with the labyrinth-like ribs 2 and 2*a*, a gas-tight joint between the suit and mask. The number and height of the labyrinths required to produce a reliable gas-tight joint will depend on the place where the connection is made, but at least two labyrinths should be provided.

An additional form of construction made in accordance with this invention is one in which the inside surface of the elastic band is also provided with surrounding laterally spaced ribs.

Using the ideas on which this invention is based, a gas-tight connection can be provided between a protective device and the human body. For example, the respirator mask can be provided inside with a sealing flange 6 that fits elastically around the entire face and against the head, the sealing flange being provided with a number of laterally spaced ribs 7 formed so as to produce a number of labyrinth seals, the ribs being spaced only a short distance apart and extending entirely around the sealing flange. By this means, ribs 7 will lie against the head and face and will seal the interior of the mask from the surrounding atmosphere.

A connection made in accordance with this invention can also be advantageously employed for connecting in a gas-tight manner different parts of clothing to a protective suit. Thus, for example, gloves can be attached to the sleeves of a blouse, and shoes to stockings, using the proposed connection and thereby forming a protective garment that is sealed off in a gas-tight manner from the surrounding atmosphere.

I claim:

1. A connection between two parts of a flexible protective covering for a person, with one of said parts having an opening therein facing the other part, said connection comprising an elastic band having one edge secured to said one part around said opening, the band extending away from said one part and surrounding a portion of the other part, the free edge of said band being thickened relative to the adjoining portion thereof and provided with a continuous groove in its inner surface extending around said thickened portion, the outer surface of the portion of said other part surrounded by the band being provided with surrounding laterally spaced ribs including one rib projecting into said groove and holding said two parts of said protective covering together.

2. A connection according to claim 1, in which said one part of the protective covering is a protective suit and said other part is a respirator mask, with said ribs surrounding the marginal portion of the mask that engages forehead and cheeks and chin, and said one rib being the rib farthest removed from the edge of the mask.

3. A connection according to claim 2, in which said mask is provided inside with an elastic sealing flange for surrounding the face in engagement therewith, and the face-engaging side of the flange is provided with laterally spaced ribs extending around it to form a labyrinth seal against the face.

4. A connection according to claim 1, in which said ribs are disposed in sealing engagement with the inside of said band.

5. A connection according to claim 1, in which said ribs form a labyrinth seal with said band.

6. A connection according to claim 5, in which there are at least two labyrinths.

7. A connection according to claim 1 or 5, in which the inner surface of said band is provided with laterally spaced encircling ribs forming a labyrinth seal with said other part of the protective covering.

* * * * *